United States Patent [19]

Skach, Jr. et al.

[11] Patent Number: 4,992,096

[45] Date of Patent: Feb. 12, 1991

[54] METALLOTHERMIC REDUCTION OR RARE EARTH METALS

[75] Inventors: Edward J. Skach, Jr., Freeport; Kenneth G. Claus; Matthew R. Earlam, both of Lake Jackson, all of Tex.

[73] Assignee: The Dow Chemical Company, Midland, Mich.

[21] Appl. No.: 364,770

[22] Filed: Jun. 9, 1989

[51] Int. Cl.[5] ..... C22B 26/22; C22B 59/00

[52] U.S. Cl. ..... 75/588; 75/597; 75/610; 420/405; 420/416

[58] Field of Search ..... 75/67 R, 84, 84.4, 84.5, 75/588, 597, 610; 420/83, 405, 416

[56] References Cited

U.S. PATENT DOCUMENTS 4,636,353 1/1987 Seon et al. ..... 420/416

*Primary Examiner*—John P. Sheehan
*Assistant Examiner*—George Wyszomierski
*Attorney, Agent, or Firm*—W. J. Lee

[57] ABSTRACT

In a metallothermic process for reducing rare earth metal salts to produce pure rare earth metals and metal alloys, e.g. neodymium or neodymium/iron alloy for use in manufacturing neodymium/boron/iron permanent magnets, including adding pure metallic iron, such as iron flake, to a mixture of metal salt, such as neodymium chloride, and a reducing metal source, such as calcium/magnesium alloy, heating in a crucible in a preheated high temperature furnace with stirring to a temperature of 900 degrees C. under a flow of argon, separating the metal from the salt formed, and purifying the metal via distillation.

8 Claims, 3 Drawing Sheets

METALLOTHERMIC REDUCTION OR RARE EARTH METALS

BACKGROUND OF THE INVENTION

This invention relates to a metallothermic process for the reduction of rare earth metals, more particularly, this invention relates to the reductants used for reducing neodymium chloride to neodymium metal.

Rare earth metals are normally formed by reducing rare earth oxides with granular calcium metal at high temperatures, for example 1100 degrees and up.

U.S. Pat. No. 4,578,242 discloses reducing neodymium oxide with granular calcium metal to form neodymium alloys with iron or zinc. The above process is carried out by reacting neodymium oxide with sodium or granular calcium in a molten calcium chloride-sodium chloride matrix and forming a neodymium-iron or neodymium-zinc alloy. This is done at 700 degrees C. in a helium atmosphere, after which the product alloy is allowed to phase separate, and is recovered. The by-product calcium oxide accumulates in the reaction vessel and causes the melting point of the matrix to increase, limiting the number of cycles possible before an entirely new charge of salt is needed.

The disadvantage of using pure granules of calcium is that such material is difficult to handle and may pose a hazard for operators handling such material because of the temperatures involved with the process.

It is therefore desired to provide a process which is relatively cheaper, easier, and safer to prepare neodymium metal or neodymium/iron alloy via the calciothermic reduction of neodymium salts. It is further desired to provide a process which solves the problem of handling pure calcium metal, and allows the reaction to be run at lower temperatures.

SUMMARY OF THE INVENTION

The present invention is directed to a process for producing neodymium metal by a calciothermic reduction of neodymium salts by reducing the neodymium salts with a calcium/magnesium alloy whereby the temperature of the reaction process is lowered.

In the present invention, by using calcium/magnesium alloy as the calcium source, the calcium is in a much safer and easier to handle form than pure, granular calcium. Also, by adding pure iron to the reaction mixture, and using neodymium chloride instead of neodymium oxide, the reaction can be run at temperatures well below the standard technology, and will be a two phase, all liquid system, which allows for easier separation of product and slag.

DETAILED DESCRIPTION OF THE PREFERRED EMBODIMENT(S)

The present invention includes a metallothermic process for reducing rare earth metal salts to produce pure rare earth metals and metal alloys such as neodymium or neodymium/iron alloy for use in manufacturing neodymium/boron/iron permanent magnets.

In accordance with the process of the present invention, a calcium/magnesium metal alloy is used as a reducing metal for the rare earth metal salts, such as neodymium chloride.

The calcium/magnesium metal alloy is obtained, for example, by producing the alloy by molten salt electrolysis as described in U.S. patent application Ser. No. 364,769, entitled "PROCESS FOR PRODUCING A REACTIVE METAL-MAGNESIUM ALLOY" filed by, K. G. Claus et al. of even date herewith, incorporated herein by reference.

Figure 3:
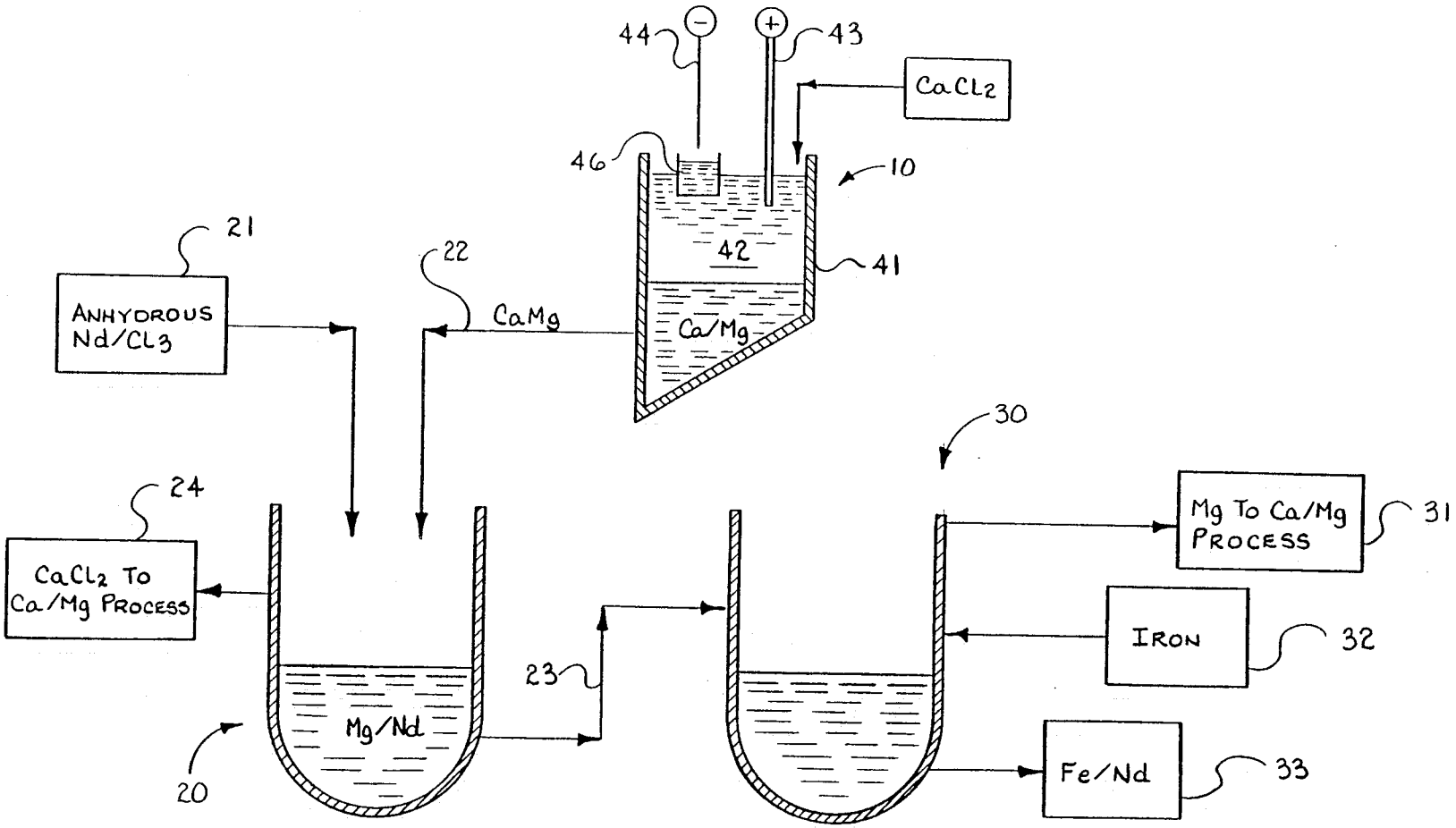
FIG. 3 is a schematic flow diagram showing another embodiment of a metallothermic process using the present invention.

With reference to FIG. 3, this process generally involves first melting an electrolyte 42 in an electrochemical structure 41 at a temperature of from about 650 to about 800 degrees C. and the cell 10 is operated at this same temperature range to maintain the electrolyte in a molten state.

Anode 43 is inserted into the molten electrolyte.

A liquid magnesium cathode 44 is prepared by adding a magnesium cathode material to the container 46 and by melting the cathode material in the container 46. The melting of magnesium metal is carried out between about 650 and about 800 degrees C. The molten cathode floats on the surface of the electrolyte. An electrical element is connected to the molten magnesium. Electrical contact is made between the two electrodes and current is passed through the cell at a current density of about 0.1 to about 20 amperes per square inch for the appropriate number of ampere hours necessary to achieve the desired alloy composition.

Calcium metal from the molten salt bath is electrically deposited into the molten magnesium cathode to form an alloy of a calcium metal and magnesium in the container 46. The current is then turned off and the calcium/magnesium product is removed from the cell 10 in stream 22. The calcium/magnesium produced in cell 10 can then be used in the process described with reference to FIG. 2 for producing a neodymium iron product.

Figure 1:
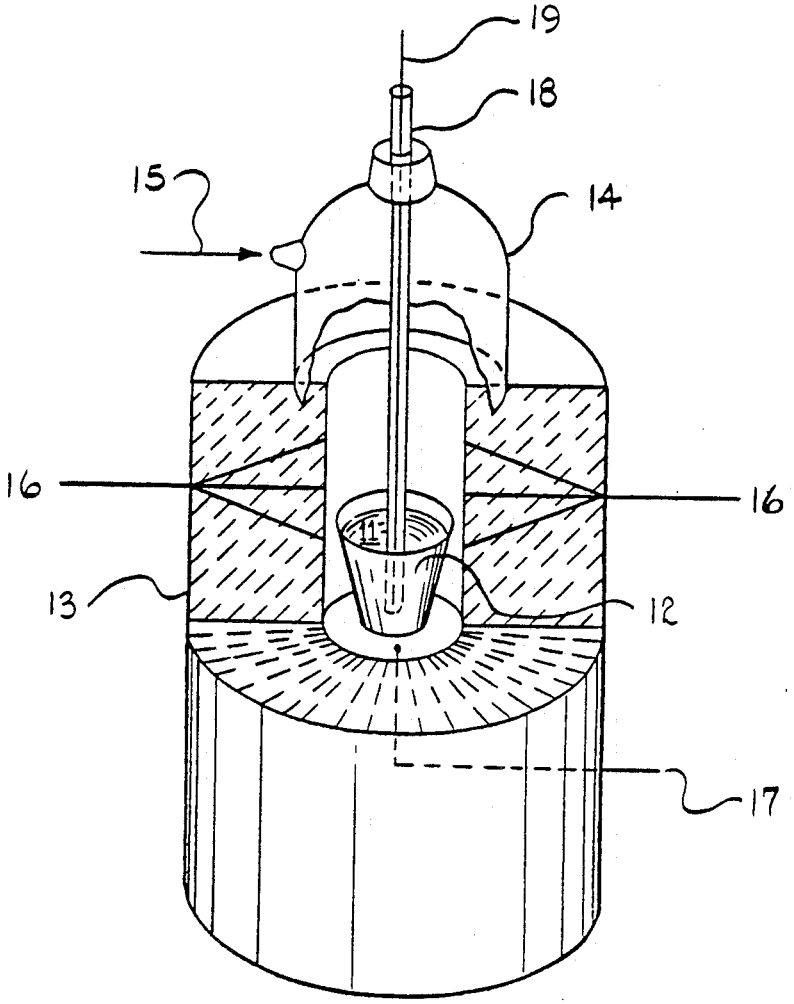
FIG. 1 is a cross-sectional view showing an apparatus for carrying out the process of the present invention.

In carrying out one embodiment of the process of the present invention and with reference to FIG. 1, a rare earth metal salt, calcium/magnesium metal as a reducing metal and iron powder are mixed in a container (not shown). The contents of the container are then poured into a crucible 12 in a furnace 13 having heater elements 16 and a furnace thermocouple 17. The crucible and its contents 11 are heated to a temperature of from about 800 to about 825 degrees C. Preferably, the mixture is heated to a temperature of about 800 to about 900 degrees Centigrade under a flow of an inert gas such as argon 15 under a glass dome 14 of the furnace 13. Preferably, the mixture is stirred with a stirrer 18 and maintained at a temperature of from about 900 to about 925 degrees C. The stirrer 18 may be a combination stirrer and thermowell such as a hollow alumina rod with a closed bottom for inserting a crucible thermocouple 19 therein for measuring the temperature in crucible 12. Generally, stirring is carried out for about 5 to about 8 minutes. During this step an alloy and a salt product such as calcium chloride is formed.

The resultant alloy and the end product calcium chloride are both liquids that are not miscible and separate readily giving a very clean or pure rare earth alloy metal. The densities of the rare earth alloy and calcium chloride are such that the rare earth alloy settles quickly to the bottom of the reaction vessel with the calcium chloride covering the metal. This allows the alloy to be protected from atmosphere nitrogen, oxygen and water vapor that could cause the alloy to oxidize or degrade. Since the reaction products are all liquids, they can be drawn off easily or allowed to freeze and then separated in the solid state.

In one embodiment, the stirred mixture is rapidly cooled to a temperature of from about 500 to about 525 degrees C. Rapid cooling is necessary to stop any back reaction of the product metal such as neodymium with the calcium salts. For example, a cooling rate of 50 degrees C./minute is suitable. A frozen salt solid with a button of metal under it is formed. The salt and the metal button can be readily physically separated. The resultant metal alloy of rare earth and iron is separated from the salt formed by conventional physical/mechanical means, for example, on a laboratory scale the product obtained is broken up with a hammer since the salt is broken away from the button without breaking the metal alloy. Thereafter, the metal alloy is purified by conventional process such as a distillation process.

Figure 2:
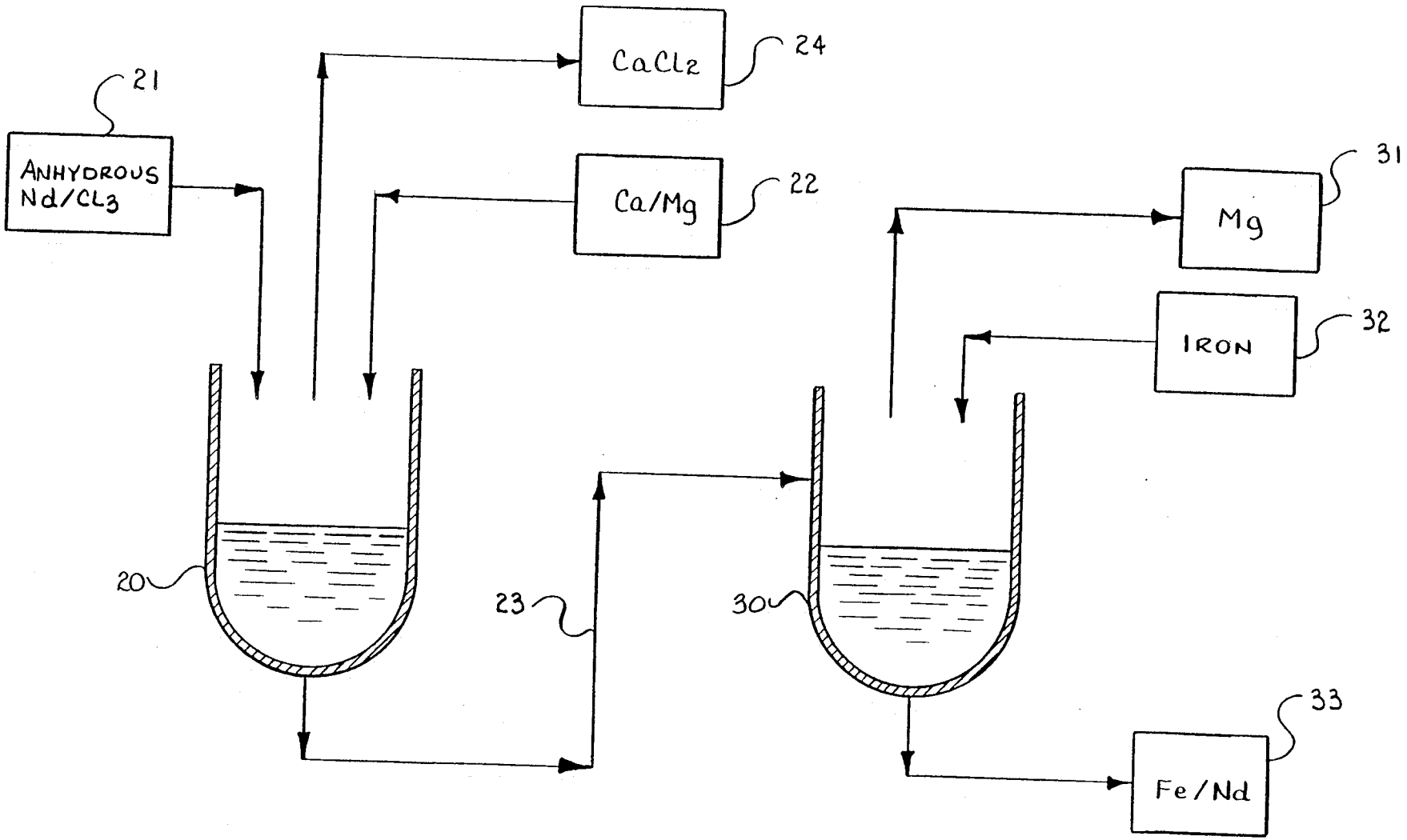
FIG. 2 is a schematic flow diagram showing a metallothermic process using the present invention.

With reference to FIG. 2, there is shown one embodiment of the process of the present invention wherein a neodymium chloride 21 is fed into a reactor vessel 20 with a reducing metal 22 such as calcium/magnesium to form a product 23 or magnesium/neodymium alloy which is then fed into a separator vessel 30. Calcium chloride 24 is evolved from vessel 20 and recovered for further use in vessel 30. Magnesium 31 is distilled and recovered for use in preparing more magnesium/calcium material or the magnesium may be transferred to another use point. As shown in FIG. 2, iron 32 is added to the distillation vessel 30 to form a neodymium/iron alloy product 33 which can be used for producing neodymium based permanent magnets.

The neodymium chloride may be produced by any number of conventional methods, for example, a neodymium chloride may be produced by mixing a neodymium nitrate and sodium hydroxide to form a neodymium hydroxide and then reacting the neodymium hydroxide with hydrochloric acid to form a neodymium chloride. The hydrated $NdCl_3$ is dried with air and HCl to form an anhydrous $NdCl_3$. The anhydrous neodymium chloride is then fed into a mixing reactor vessel 20 with a reducing metal to form a magnesium/-neodymium alloy.

EXAMPLE

A dry box is purged with argon to exclude oxygen and water from the dry box. In the argon purged dry box mix together 33.3 grams of anhydrous neodymium chloride and 38.25 grams of magnesium/calcium alloy (23.2% Ca, 76.8% Mg) and 3.3 grams of electrolytic iron powder. Place this mixture in a 4 ounce bottle and cap and shake vigorously for about five minutes. Remove the bottle containing the mixture from the dry box but do not open to the air until ready to use.

Preheat a furnace, for example as shown in an apparatus similar to that substantially shown in FIG. 1, to at least 500 degrees C. for 4 hours to dry out the furnace. Cool the crucible to about 200° C. quickly and pour the previously mixed neodymium chloride, magnesium/calcium alloy and iron into the crucible. Place a glass dome on the furnace and pass an argon stream through the dome at a flow of about 2 SCFH. Turn on the furnace to a setting control temperature of 1000° C. Place a thermowell/stirrer into the mixture and allow to heat up. When the temperature of the crucible has increased to about 800° C., start stirring the mixture (which should be liquid). Continue to stir the mixture and allow the crucible temperature to increase to 900° C. When this temperature has been reached, turn off the furnace and allow the crucible to cool to 200° C. as rapidly as possible. Keep the argon purge on at all times until the temperature has dropped below 200° C. Then remove the crucible from the furnace and remove the contents from the crucible.

The resultant products of the reaction include a frozen salt solid of calcium chloride with a button of metal under it. The salt and button of metal alloy is easily removed from the crucible. The calcium chloride salt is removed from the metal alloy button by physical means. This salt removal should be accomplished in a dry atmosphere. The button is removed from the salt and analyzed for its metal content by conventional analytical methods and found to contain 22% neodymium metal, 4% calcium metal, 64% magnesium metal and 2.7% iron metal. Total button weight; 35.81 grams for a neodymium conversion of 50%. The magnesium is removed from the alloy by standard distillation technology, and the unreacted neodymium chloride can be recycled to a reactor.

What is claimed is:

1. A process for producing an alloy of Fe and at least one rare earth metal by starting with at least one calciothermically reducible compound of said rare earth metal(s), said process comprising (1) forming a melt of (a) the rare earth metal compound(s) and (b) a Ca/Mg metal alloy, whereby the Ca reduces the rare earth metal compound(s), thereby forming a molten Ca compound and a molten alloy of Mg and rare earth metal(s), (2) separating the molten Ca compound from the molten alloy of Mg and rare earth metal(s), (3) introducing iron into the molten alloy of Mg and rare earth metal(s), thereby forming an alloy of iron and rare earth metal(s), and (4) removing the Mg from the molten alloy of iron and rare earth metal(s).

2. The process of claim 1 wherein the temperature of the molten materials is from about 800 to about 900 degrees C.

3. The process of claim 1 wherein the rare earth metal compound comprises neodymium halide.

4. The process of claim 1 wherein the rare earth metal compound comprises neodymium chloride.

5. The process of claim 1 wherein the amount of calcium in the calcium/magnesium alloy used is from about 95 to about 120 percent of the theoretical amount needed to reduce neodymium chloride.

6. The process of claim 1 wherein the amount of calcium in the calcium/magnesium alloy is from 10 to 50 weight percent.

7. The process of claim 1 including an additional step of removing the Mg from the molten alloy of iron and rare earth metal(s) and converting the Mg to an alloy of Ca/Mg.

8. The process of claim 1 including an additional step of removing the Mg from the molten alloy of iron and rare earth metal(s) converting the Mg to an alloy of Ca/Mg, and using the Ca/Mg alloy again for the calciothermic reduction of at least one rare earth metal compound.

* * * * *